United States Patent [19]

Shibata

[11] 4,037,507

[45] July 26, 1977

[54] CAPO TASTO

[76] Inventor: Masataka Shibata, 2-2-3, Kamiosaki, Shinagawa, Tokyo, Japan

[21] Appl. No.: 666,021

[22] Filed: Mar. 11, 1976

[30] Foreign Application Priority Data

Mar. 14, 1975 Japan ..... 50-65668[U]

[51] Int. Cl.[2] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 1,788,636 | 1/1931 | Russell | 84/318 |
| 3,504,589 | 4/1970 | Wowries | 84/318 |
| 3,903,776 | 9/1975 | Owen | 84/318 |

*Primary Examiner*—Lawrence R. Franklin

*Attorney, Agent, or Firm*—Anthony J. Casella; Joseph Calvaruso

[57] ABSTRACT

A capo tasto made of a metallic plate, a medium count nylon string, a synthetic rubber plate and other accompanying improvements, compresses the guitar neck and tightens the guitar strings by combined pressure of a synthetic rubber plate and a medium count nylon string, the construction of the said apparatus being simplified and the operation thereof being convenient and handy.

5 Claims, 2 Drawing Figures

CAPO TASTO

This invention relates to the construction of a capo tasto which presses a guitar neck, and tunes a guitar.

More specifically, the invention is characterized by structure of the apparatus, essential parts thereof consisting of a metallic plate, a medium count nylon string, a synthetic rubber plate and other accompanying improvements.

A main object of the present invention is to provide for an improved capo tasto, which compresses the guitar neck and tightens guitar strings by combined pressure of a synthetic rubber plate and a medium count nylon string, the construction of the said apparatus being simplified and the operation thereof being convenient and handy.

Referring to the drawings.

Figure 1:
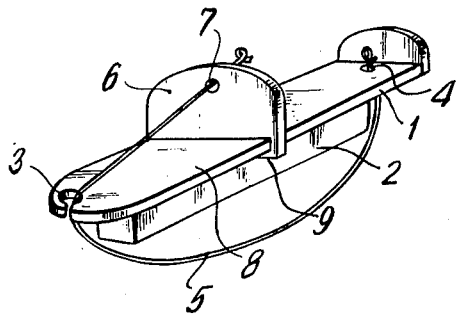
FIG. 1 is a perspective view of the subject invention.

According to the drawings, reference will be made to an embodiment of the invention as follows:

As shown in FIG. 1, the numeral 1 designates a rectangular metallic plate of 71 mm in length and 12 mm in width with its four corners being formed round, the under side thereof being provided with a synthetic rubber plate 2 of a smaller size than the said metallic plate 1. An end of the retangular metallic plate 1 has a notch 3, while the other end is perforated with a small hole 4, wherein a medium count nylon string 5, corresponding to No. 3 count gut of a guitar, is threaded. The end of the string 5 threaded through hole 4 is preferably knotted after it is passed through said hole so that the string is prevented from repassing through hole 4, and is effectively secured to plate 1. The other end of the said nylon string 5, passing through the notch 3, is threaded in a small hole 7 perforated at upper center of a semi-elliptical metallic tension control member 6. Said end of string 5 is also preferably knotted so that it is effectively secured to the tension control member 6. Thus, the nylon string 5 is secured so as not to be released from the small holes 4 and 7 by means of the knots. The base portion of tension control member 6 includes a centrally located generally T-shaped slot, formed longitudinally therein, and having substantially parallel side walls. Said slot has upper and lower sections, the width of the upper section being greater than the width of the lower section. As is apparent in FIG. 1, plate 1 is slidingly receivable in the upper section of the slot, and plate 2 is slidingly receivable in the lower slot section.

Figure 2:
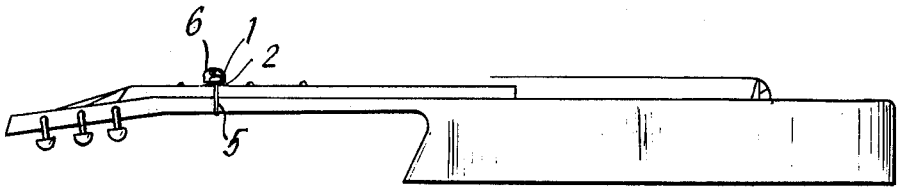
FIG. 2 is a front view of the subject invention.

Referring to FIG. 2, which illustrates the operation of the subject invention, it is apparent that a guitar neck is receivable in the space defined between plate 2 and string 5. As the tension control member 6 is slid along plates 1 and 2 in a direction away from notch 3, the guitar neck is subjected to the combined pressure of the rubber plate 2 and the nylon string 5, thereby heightening the tone of the musical instrument.

When the apparatus is moved on the guitar neck and the semi-elliptical metallic tension control member 6 is moved toward the notch 3 by the finger, a strained nylon string 5 between the said notch 3 and the small hole 7 perforated at upper center of the same metallic member 6 is loosened thereby, the compression on the guitar neck is relaxed, and the apparatus may move on the neck smoothly.

What is claimed is:

1. A capo tasto comprising:

a first plate member, generally rectangular in configuration, said first plate member having a notch at one end thereof;

a second plate member, generally rectangular in configuration, said second plate member being smaller in area than said first plate member, said first plate member being secured to and superposed over said second plate member;

a tension control member having at one end thereof a centrally located generally T-shaped slot formed longitudinally therein and having substantially parallel side walls, said slot having upper and lower sections, the width of said upper section being greater than the width of said lower section, said first plate member being slidingly receivable in said upper slot section, and said second plate member being slidingly receivable in said lower slot section; and a string element, one end thereof being secured to the end of said first plate member opposite that having the notch, the other end of said string element being slidingly received in the notch of said first plate member and secured to the tension control member, there being a space defined between said second plate member and said string element for receiving the neck of a guitar, said guitar neck being subject to compresion from both said second plate member and said string element whereby tension on the guitar strings may be continuously varied by sliding said tension control member along said first and second plate members.

2. A capo tasto as recited in claim 1 in which said first plate member is metallic.

3. A capo tasto as recited in claim 1 in which said second plate member is rubber.

4. A capo tasto as recited in claim 1 in which said string element is a medium count nylon string.

5. A capo tasto as recited in claim 1 in which said tension control memberis generally semi-elliptical in configuration.

* * * * *